United States Patent [19]

Velazquez

[11] 4,046,244

[45] Sept. 6, 1977

[54] IMPACT MATRIX PRINT HEAD SOLENOID ASSEMBLY

[75] Inventor: Juan F. Velazquez, Ann Arbor, Mich.

[73] Assignee: Sycor, Inc., Ann Arbor, Mich.

[21] Appl. No.: 602,202

[22] Filed: Aug. 6, 1975

[51] Int. Cl.[2] ..... B41J 3/04

[52] U.S. Cl. ..... 197/1 R; 101/93.29; 101/93.34; 335/229

[58] Field of Search ..... 197/1 R; 101/93.04, 101/93.05, 93.09, 93.14, 93.29, 93.32–93.34, 93.48, 93.02; 335/229, 258, 274

[56] References Cited

U.S. PATENT DOCUMENTS

| | | | |
|---|---|---|---|
| 3,070,730 | 12/1962 | Gray et al. | 335/229 |
| 3,119,940 | 1/1964 | Pettit et al. | 335/229 X |
| 3,172,352 | 3/1965 | Helms | 101/93.34 |
| 3,285,166 | 11/1966 | Helms et al. | 101/93.34 |
| 3,460,469 | 8/1969 | Brown et al. | 101/93.34 |
| 3,672,482 | 6/1972 | Brvmbaugh et al. | 197/1 R |
| 3,707,122 | 12/1972 | Cargill | 101/93.34 |
| 3,787,791 | 1/1974 | Borger et al. | 197/1 R X |
| 3,831,729 | 8/1974 | Howard | 197/1 R |
| 3,831,730 | 8/1974 | Koeppe | 197/98 |
| 3,842,734 | 10/1974 | Gomi | 101/93.34 |

*Primary Examiner*—Ralph T. Rader

*Attorney, Agent, or Firm*—Price, Heneveld, Huizenga & Cooper

[57] ABSTRACT

A dot matrix impact print head uses a combination of cooperating forces produced by a deflected spring and dual electromagnetic fields to increase the striking force of a printing wire or needle element without adversely affecting operating frequency capabilities.

12 Claims, 4 Drawing Figures

IMPACT MATRIX PRINT HEAD SOLENOID ASSEMBLY

BACKGROUND

1. Field of the Invention.

This invention relates to printing machines in general, and more specifically to print head assemblies for impact matrix, or dot, printers.

2. Description of the Prior Art

In impact matrix printing apparatus, individual needle-like printing elements are thrown longitudinally to impact endwise against a recording medium, thereby forming a dot on the medium. Each such dot is usually part of a dot pattern which forms a given alphanumeric character, the pattern being selected from a matrix of possible dot positions. Typically, individual electromagnetic actuators are used for each printing needle, or wire, as they are often referred to. The actuators have to move the wire with sufficient force to impact the medium, and then withdraw the wire so it is clear of the medium. While speed is a major consideration in such printing apparatus, the impact force of the wire against the medium is also very important, since the force must be sufficient to produce the desired image. Clearly, a force sufficient to merely produce an image on a single sheet of paper when the wire is separated from the paper by only an ink-carrying ribbon is probably insufficient to produce the required image on each sheet when the medium is a plurality of sheets of paper with intervening sheets of carbon paper.

Prior impact needle actuators such as that shown in U.S. Pat. No. 3,592,311 to A. S. Chou et al. have used a printing wire associated with an electromagnet armature and a leaf spring. The wire is connected to the armature and the armature is connected to the leaf spring. An electromagnet holds the armature so that the leaf spring is in a flexed position. When the magnetic coil is deenergized the armature and the wire are propelled forward by the leaf spring to a printing position. Energizing the magnetic coil then retracts the wire from the printing position to a retracted position and at the same time flexes the leaf spring once again, recocking the actuator. Much the same principle is used in U.S. Pat. No. 3,672,482 issued to Brumbaugh et al. However, instead of having an electromagnet which is deenergized to release the armature and the spring, there is a permanent magnet whose field is overcome by activating an electromagnet having a field which is the reverse of the permanent magnet field and approximately equal in magnitude. Typically, one can expect a force of about one and one-half pounds from such spring-actuated printing wires. A typical operating speed is about 40 characters per second.

A somewhat greater force, for example about three pounds, can be obtained by a system which uses an electromagnet to impell the wire from a retracted position into a printing position. Typical operating speed for such an arrangement is about 165 characters per second. Normally, the wire is retained in a retracted non-printing position by a spring. The force created by the electromagnet overcomes the retaining force of the spring. For example, U.S. Pat. No. 3,584,575 issued to J. Distl teaches a wire connected to an armature which in turn is connected to a coil spring that holds it in a retracted nonprinting position. The armature is within a magnetic coil and near a core piece. Whe the magnetic coil is energized the coil and the core piece act to attract the armature and move it and the connected printing wire into a printing position. In the printing position, the spring is resiliently flexed from its normal position. De-energizing the magnetic coils allows the spring to return to its normal unextended position, which returns the print wire to a retracted, non-printing position. Similarly, U.S. Pat. No. 3,690,431 issued to R. Howard teaches a system where energization of the solenoid coil rapidly moves the printing wire in the impact printing direction, against the bias of a spring. In this particular patent the spring, instead of being a coil spring as in the Distl patent, is in the shape of a wagon wheel. The armature is connected to the hub of the wagon wheel, movement of the armature causing the spokes of which to elastically deflect relative to the rim.

SUMMARY

This invention provides a printing head which greatly increases the resulting impact force of the print needle by effectively combining forces from oppositely-directed magnetic fields. In so doing, a permanent magnet holds an armature connected to a print wire in a retracted, non-printing position, thus applying a holding force to the armature and deflecting a spring coupled to the armature, thereby storing energy in the spring. An electromagnet is energized to produce a magnetic field which acts on the armature and overcomes the field of the permanent magnet. Additionally, the field produced by a second electromagnet has a component which urges the interconnected armature and print wire away from their retracted position and toward a printing position. Accordingly, the armature and the connected printing wire are accellerated to a printing position by combined and jointly-acting forces obtained by releasing the energy stored in a deflected spring and energizing an electromagnet to create a forwardly-impelling magnetic field.

The force imparted to a printing wire in accordance with an embodiment of this invention can be as much as seven pounds, using the same order of component size and actuating power as that producing merely the one and one-half to 3 pounds provided by prior art devices. Such a magnitude of force was not and could not be obtained in the prior art from a practical point of view because of magnetic saturation and/or practical limits on the allowance size and mass of the actuating mechanism. Typically, to increase the printing force would require increasing the driving spring force in one case and the driving magnetic field force in another case. If the driving spring force is increased then the magnetic force which overcomes the spring force to return the printing wire to a retracted position must be increased. As discussed further below, this requires an increase in the size and mass of the spring and of the magnetic flux circuit which can adversely affect the speed of operation. Increasing the driving magnetic field force requires a corresponding increase in the capability of the magnetic circuit to handle the increased magnetic flux. The moveable armature attached to the printing wire is part of the magnetic flux circuit and must be increased in flux-handling ability and therefore mass. Thus, the increase in spring and/or magnetic field forces does not produce a correspondingly great increase in printing force because of the greater masses to be moved. Further, the greater mass of the armature of spring results in a longer time being required for the printing wire to cycle form a retracted position to a printing position and back to a retracted position. While printing force is important, printing speed is also a major consideration. Also, the increase in spring size and magnetic circuit size makes compact arrangement of numerous wires, as is required in a printing head, a difficult objective to achieve.

The present invention provides a solution to a problem not solved by the prior art. Using a combination of both spring forces and magnetic field forces to propel a printing wire increases printing force while maintaining printing speed and permitting compact arrangement of the driving apparatus for printing wires.

DRAWINGS

DETAILED DESCRIPTION

Figure 1:
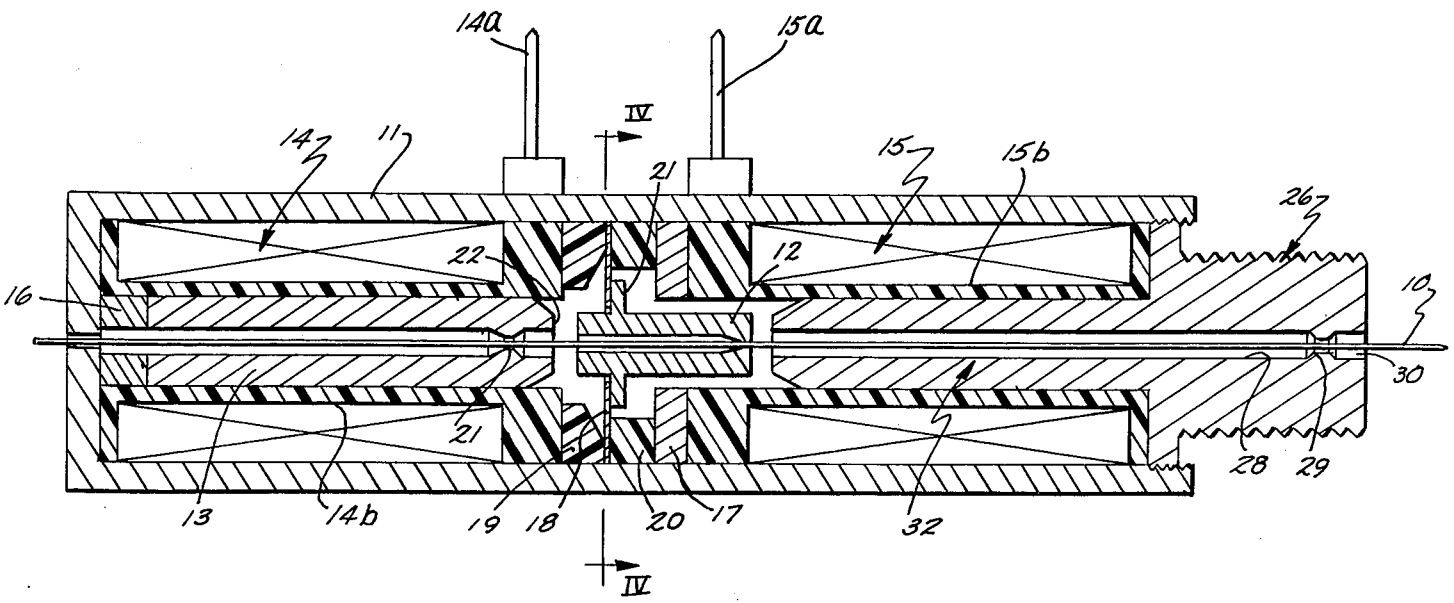
FIG. 1 is a central longitudinal cross-section of a print head solenoid structure in accordance with this invention.

Referring to the drawing, a printing wire 10, which may be of tungsten, extends through and is connected to an elongated cylindrical armature 12 of magnetic metal which is axially aligned in the central cylindrical opening of a casing 11, also of magnetic material, which houses a pair of electrical windings or coils 14 and 15 having connection posts or terminals 14*a* and 15*a*, respectively, extending outwardly of casing 11.

Magnetic casing 11 is basically cylindrical, with a central generally cylindrical opening defined by the interior of the plastic or other non-magnetizing spools 14*b* and 15*b* carrying the windings 14 and 15, armature 12 being axially movable within such central opening. The print wire or needle 10 is axially aligned with armature 12 and disposed within a central cylindrical opening therein, extending axially beyond casing 11 and winding 5 in the direction of a printing medium (not shown). An ink-carrying ribbon (not shown) is typically positioned between the printing medium and the end of print wire 10.

Preferably, for support and improved control, a cylindrical end guide 26 is positioned at the forward end of the housing 11, the guide 26 being threaded into the end of the housing to close it and cover the end of magnetic winding 15. Guide 26 has a central guide passage 28, through which print wire 10 extends rearwardly, toward (and through) the armature, or plunger 12. As illustrated, guide passage 28 is necked down near its end at portion 29, to help support the print wire and provide a seat for a jewel or other suitable bearing 30, mounted in guide passage 28 at its extreme outer end. Also as illustrated, the end guide 28 has an integral rearwardly-extending portion 32 which fits inside the coil or winding 15 and forms a pole-piece therefore, such portion being of magnetic material. The front projecting portion 27 of guide 26 may be externally threaded, as shown, to function as a mount for the solenoid, or for other purposes such as mounting a ribbon guide or mask (not shown) or the like.

A permanent magnet 16 is mounted at the end of the central cylindrical opening of the device, inside the end of spool 14*a* on which coil 14 is wound. A central pole piece 13 of magnetic material is also mounted in this cylindrical opening inside spool 14a and adjacent permanent magnet 16, the pole piece extending toward armature 12 and abutting the latter when the armature is moved rearwardly into its retracted, non-printing position. Pole piece 13 is necked down at 22 and mounts a bearing 23 for the print wire to slide in, as in the case of threaded pole piece 32.

An anti-residual washer-shaped member 17 of magnetic metal is disposed between collar 20 and the near end of winding spool 15*b* to provide a magnetic return path for flux conduction between armature and the housing during each cycle of armature movement.

A disc-type spring 18 is disposed directly behind the armature 12 and held in fixed position by, and between, a pair of plastic or other non-magnetic annular washers or collars 19 and 20.

Spring 18 may be of a commercially available nature, typically having a series of radial slots or other such openings extending outwardly from its inside diameter, as illustrated, to form spring tines or fingers which may if desired actually be separate segments from one another. As illustrated, the armature 12 has an outwardly-projecting circular flange or skirt 21 which indexes against the front face of spring 18 to flex the inner diametral portion thereof (e.g., the slotted spring fingers in the embodiment shown) rearwardly relative to the outer diameter. As shown, the forward face of collar 19 is chamferred or bevelled to allow such rearward axial flexure of spring 18.

Armature 12 is attached to the print wire or needle at the forward end of the armature, where it is necked-down at 12*a* to closely fit about the print wire as the same passes through the armature. Thus the print wire is secured to the armature but slidable by axial movement through the pole pieces. A typical distance of axial travel for armature 12 is about 0.070 inches. A typical radial gap between armature 12 and the inside diameter of the spools or bobbins 14*b* and 15*b* on which the coils 14 and 15 are wound is about 0.010 inches.

OPERATION

In a totally quiescent state, without energization of either coil 14 or 15, permanent magnet 16 attracts armature 12 with sufficient force to retract it into contact with the end of pole piece 13, thereby spacing the end of wire 10 from the printing medium. This is accomplished by flexure of spring 18 which, in the particular embodiment described is a washer type spring which deforms axially to form a cone-shaped structure. The effect of energizing coil 14 under these conditions is to create a magnetic field which opposes and overcomes the magnetic field of permanent magnet 16. As a result, armature 12 and wire 10 are urged forward away from pole piece 13 and toward a printing position by the energy stored in the spring. At the same time, energizing coil 15 creates an additional impelling force which throws the armature forward with increased forced produced by the magnetic field of winding 15 acting on the armature, in cooperation with the spring force.

De-energizing coils 14 and 15 eliminates the magnetic fields which oppose (and which overcomes) the magnetic field of permanent magnet 16. Accordingly, the field produced by permanent magnet 16 will then withdraw armature 12 and wire 10 from the printing position to a retracted position. Armature 12 then travels along the cylindrical opening in casing 11 toward permanent magnet 16 until the armature abuts pole piece 13. In this retracted position, spring 18 is again flexed, and again has stored energy due to its deflection.

Figure 2:
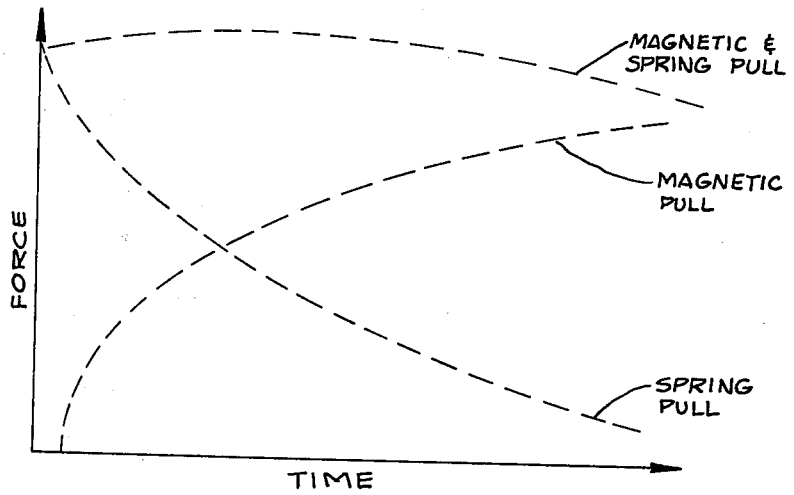
FIG. 2 is a graphical representation of the force produced to act on the printing wire, with respect to time.
Figure 3:
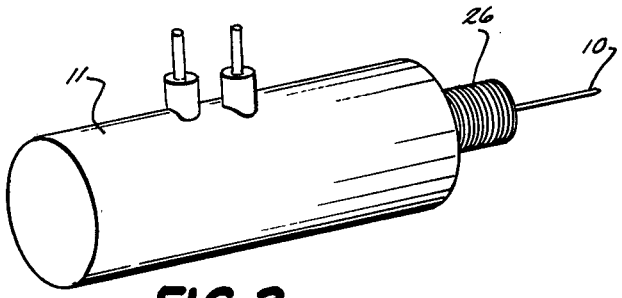
FIG. 3 is a perspective view of the print head solenoid in accordance with an embodiment of this invention.
Figure 4:
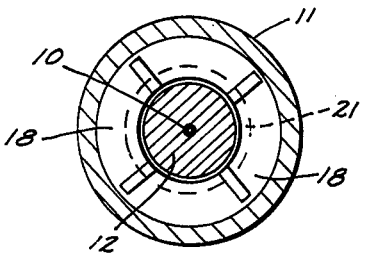
FIG. 4 is a transverse cross-section along section line IV—IV of FIG. 1 through a central portion of the print head solenoid in accordance with an embodiment of this invention.

The advantages of using both stored mechanical energy (spring force) and magnetic forces to drive a printing wire are shown in FIG. 2. A graphical representation of resultant armature driving force with respect to time shows that spring-driven armatures have an instantaneous high force which rapidly decreases with time while magnetically-driven aramatures have an initially low force which builds with time. Each has disadvantages, in that there is either a slow acceleration at first (magnetic drive) or a low ultimate force at the time the printing wire strikes the printing medium (spring drive). In contrast, combining both spring and magnetic drive in accordance with this invention produces a relatively constant force on the armature. This is advantageous for both good operating speed and striking force of the printing wire.

A further advantage of using the combination of spring and magnetic forces to drive a printing wire is avoiding an undesirable increase in the physical size and mass of components used. As pointed out above, relying on only magnetic or spring forces for driving the printing wire produces a structure generally larger than a structure in accordance with an embodiment of this invention, in any comparable force-equivalent structure. Thus groups of printing wires can be conveniently clustered into a printing head in accordance with the invention. Also, speed is not reduced because of increases in mass or size.

Various modifications and variations will no doubt occur to those skilled in the various arts to which this invention pertains. For example, the position of the permanent magnet, the shape of the coils and the configuration of spring or armature may vary from the embodiments described. These and other variations which basically rely on the spirit and concept of the invention on which this disclosure is based and which has advanced the art are all properly considered within the scope of this invention, as defined by the appended claims.

The embodiments of the invention in which an exclusive property or privilege is claimed are defined as follows.

1. A printing head driver comprising:

a printing element and a magnetically responsive armature for moving such element in response to magnetic force;

means for exerting a first force on said printing element, of a magnitude and direction to hold said element in a non-printing rest position;

spring means for providing a force directed to move the printing element away from said rest position and toward a printing position;

magnetic means for applying an actuating magnetic force to said armature, said actuating force when applied to said armature effectively counteracting said first force and additionally impelling the printing element toward a printing position in cooperation with said spring force, said actuating magnetic force and said spring force cooperatively having an effective combined force exceeding the magnitude of the first force by an amount greater than the magnitude of the spring force alone; and means for retracting the printing element from a printing position and back to said rest position upon removal of said actuating magnetic force.

2. A printing head driver as recited in claim 1 wherein the spring means comprises:

a disc-shaped washer having central portions operatively coupled to the printing element to move the latter and having peripheral portions fixed relative to at least part of the print head when the printing element is in a retracted rest position, for axial flexing of the washer to create a force urging the printing element toward a printing position.

3. A printing head driver as recited in claim 2 wherein the means for applying said first force comprises:

a permanent magnet located to apply magnetic force to said armature in a direction axially aligned with the printing element, to hold the printing element in its rest position.

4. A printing head driver as recited in claim 1 further comprising:

a magnetic casing having a central axial passage, an armature disposed for movement within said axial passage, a wire-type printing element connected to the armature, axially aligned with the direction of axial movement of the armature, and extending axially beyond the magnetic casing, a permanent magnet secured relative to the magnetic casing for providing magnetic force acting axially on the armature, such force comprising said first force holding said printing element in its rest position, and an electromagnet carried in the magnetic casing and circumferentially surrounding the axial passage for providing said actuating force, said actuating force comprising an axial magnetic force acting on the armature in opposition to and being greater in magnitude than the magnetic force produced by the permanent magnet.

5. A printing head as recited in claim 4 wherein the spring means includes a disc-shaped flexible washer disposed to contact the armature with the axis of the washer substantially coincident with the axis of the armature.

6. A printing head as recited in claim 5 further comprising stop means within said axial passage spaced from said armature defining a gap establishing the allowable forward travel of the armature from a centered position along the axial length of the central passage which is on the order of about 0.070 inches.

7. A printing head driver comprising:

an impact printing element, and both magnetic and mechanical means for acting together with mutually additive force to drive said element in a print stroke; retracting the printing element to a non-printing rest position; the magnetic means including an electromagnet for providing a force to exceed the force of said permanent magnet thereby counteracting same and additionally impelling the printing element toward a printing position; the mechanical means including a spring element operatively coupled to the printing element such that the spring is flexed when the printing element is in its retracted non-printing rest position.

8. A printing head driver comprising:

a printing element, first means for providing a first impelling force to move the printing element toward a printing position, magnetic means for providing a force to act conjointly and in cooperation with the force produced by said first means;

and a second means for producing a return force acting opposite the direction of the force produced by said first means;

said magnetic means including a pair of electromagnetic windings disposed generally adjacent one another along a common axis;

said second means including a permanent magnet generally adjacent at least one of said windings, said permanent magnet being aligned with the printing element and having a field oriented for providing a force to retract the printing element;

said electromagnetic winding generally adjacent said permanent magnet being coupled for energization to produce a field opposite that of said permanent magnet.

9. A method for impact printing, including the steps:

restraining an armature and an associated printing element together in a retracted, non-printing rest position while storing potential energy in an apparatus arranged to impell said armature upon release from such restraint; releasing said armature restraint and impelling the armature toward a printing position by use of the energy stored, and applying an electromagnetic field to the armature in a manner which additionally impells the armature in a printing direction with force greater than that resulting from release of said restraint alone, whereby the force which impells the armature in its printing direction is a composite of force from who sources.

10. A method as recited in claim 9 further comprising:

retracting the armature and printing element combination to their restrained position by use of a permanent magnetic field.

11. A method as recited in claim 9, wherein releasing said armature restraint includes the step of generating an electromagnetic field to produce a force opposing the restraining force of said armature restraint.

12. A method as recited in claim 11, including the step of using the field of a permanent magnet to restrain said armature in its retracted position.

* * * * *

UNITED STATES PATENT AND TRADEMARK OFFICE

CERTIFICATE OF CORRECTION

PATENT NO. : 4,046,244

DATED : September 6, 1977

INVENTOR(S) : Juan F. Velazquez

It is certified that error appears in the above-identified patent and that said Letters Patent are hereby corrected as shown below:

Column 1, line 67:

"Whe" should be --- When ---;

Column 2, line 67:

"form" should be --- from ---;

Column 3, line 44:

"winding 5" should be --- winding 15 ---;

Column 4, line 59:

"forced" should be --- force ---;

Column 5, line 10:

"aramatures" should be --- armatures ---;

Column 5, line 37:

"and other" should be --- and all other ---;

UNITED STATES PATENT AND TRADEMARK OFFICE

CERTIFICATE OF CORRECTION

PATENT NO. : 4,046,244

DATED : September 6, 1977

INVENTOR(S) : Juan F. Velazquez

It is certified that error appears in the above-identified patent and that said Letters Patent are hereby corrected as shown below:

Column 6, line 53:

"stroke; retracting" should be --- stroke; a permanent magnet for retracting ---;

Column 8, line 10:

"who" should be --- two ---;

Signed and Sealed this

*Thirteenth* Day of *June 1978*

[SEAL]

*Attest:*

RUTH C. MASON
*Attesting Officer*

DONALD W. BANNER
*Commissioner of Patents and Trademarks*